United States Patent [19]

Farro

[11] Patent Number: 4,796,597

[45] Date of Patent: Jan. 10, 1989

[54] ARROW REST

[76] Inventor: Henry Farro, P.O. Box 418, Hopatcong, N.J. 07843

[21] Appl. No.: 12,271

[22] Filed: Feb. 9, 1987

[51] Int. Cl.[4] ..... F41D 10/00; F41B 5/00

[52] U.S. Cl. ..... 124/41 A; 124/24 R

[58] Field of Search ..... 124/24 R, 41, 88, 86, 124/22; 40/26

[56] References Cited

U.S. PATENT DOCUMENTS

| | | | |
|---|---|---|---|
| 3,828,757 | 8/1974 | Finlay | 124/41 A |
| 3,865,096 | 2/1975 | Troncoso | 124/24 R |
| 3,871,352 | 3/1975 | Stanislawski et al. | 124/41 A |
| 3,919,997 | 11/1975 | Day | 124/24 R |
| 4,299,195 | 11/1981 | Norris | 124/24 R |
| 4,492,214 | 1/1985 | Kielhoffer | 124/41 A |
| 4,676,220 | 6/1987 | Pietraszek | 124/41 A |

*Primary Examiner*—Richard C. Pinkham
*Assistant Examiner*—Mark S. Graham
*Attorney, Agent, or Firm*—Thomas L. Adams

[57] ABSTRACT

A rest adapted to be mounted on a bow can guide an arrow into its flight direction. The rest has a flexible elongated member adapted to doubly contact the arrow and a mounting device. The mounting device can attach the flexible element to the bow. The flexible element has a lower segment and a lateral segment. The lower segment extends laterally from the bow and is positioned and sized to support the underside of an arrow. The lateral segment is spaced from and extends alongside the bow. This lateral segment has a jog at which the arrow is positionable to make single-point contact at the jog.

10 Claims, 1 Drawing Sheet

ARROW REST

BACKGROUND OF THE INVENTION

The present invention relates to arrow rests and, in particular, to rests that guide an arrow into flight while allowing its axis to translate in two orthogonal directions.

The design of an arrow rest is critical when high accuracy is needed, such as in competition. A rigid arrow rest can introduce yaw into the arrow as it is placed into flight. This obviously produces an instability that makes the flight of the arrow somewhat random from shot to shot.

It is important for an arrow rest to provide sufficient flexibility to prevent perturbations of the arrow's flight path. The rest must yield to an acceptable extent and be sufficiently light to yield quickly.

It is known to fabricate an arrow rest from a coil of spring wire whose outer end projects straight out to act as a bottom rest for the arrow. A disadvantage with this known arrow rest is that the coiled portion provides two points of contact to the side of the arrow. Therefore, there are, in total, three contact points for the arrow: two side points and one bottom point. The double side contacts adversely affect the movement of the arrow since the point of contact can change as the arrow is being launched.

Other known arrow rests formed of wire have disadvantages in that they do not allow translation of the arrow axis in two directions. For example, some arrow rests will only allow a lateral shifting of an axis, but not vertical shifting.

Accordingly, there is need for an improved arrow rest that will support an arrow without causing inaccuracies.

SUMMARY OF THE INVENTION

In accordance with the illustrative embodiments demonstrating features and advantages of the present invention, there is provided a rest adapted to be mounted on a bow to guide an arrow onto its flight direction. The rest has a flexible, elongated element adapted to doubly contact said arrow and a mounting means. The mounting means attaches the flexible element to the bow. The flexible elongated element has a lower segment and a lateral segment. The lower segment extends laterally from the bow and is positioned and sized to support the underside of an arrow. The lateral segment is spaced from and extends alongside the bow. This lateral segment has a jog at which the arrow is positionable to make single-point contact at said jog.

By employing such apparatus, an improved arrow rest is provided. In a preferred embodiment, steel wire is bent into a serpentine shape to form a rest having proper flexibility. In this preferred rest, the arrow axis can translate in two orthogonal directions. The preferred rest has a forwardly directed lower segment to support the underside of the arrow. It is joined to a higher lateral segment that supports the side of the arrow. The lateral segment is bent to form an oblique angle so that only the apex of the angle touches the side of the arrow. In this fashion, the rest touches the arrow at only two points spaced 90° apart around the arrow shaft.

In this preferred rest, the lateral segment is supported by a loop from which the flexible support forwardly extends. The support portion and lateral segment are connected at a bend at an acute angle.

The rest can be attached by a screw directly to a mounting hole in the bow. Alternatively, a vernier adjustment can be placed in the mounting hole with the rest attached thereto. The vernier provides additional adjustment for fine tuning the accuracy of the bow.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DETAILED DESCRIPTION OF THE PREFERRED EMBODIMENTS

Figure 1:
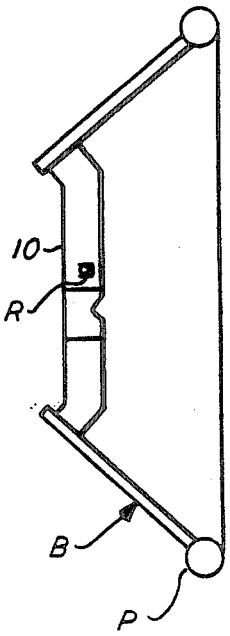
FIG. 1 is side view of a bow having a rest according to the principles of the present invention.
Figure 2:
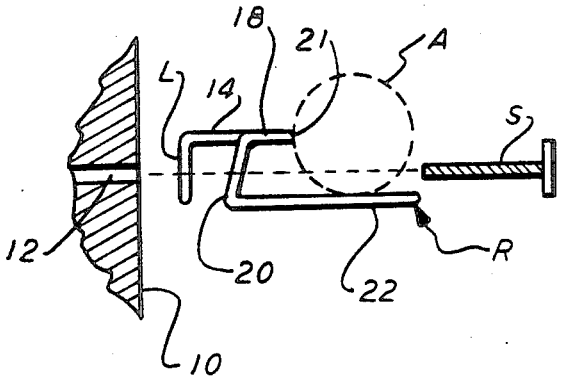
FIG. 2 is an exploded rear view of the connection of the rest to the bow of FIG. 1.

Referring to FIG. 2, a bow B has a main handle sight window 10 onto which is mounted an arrow rest R. Rest R is shown on the left side of the bow but can, of course, be mounted on the other side for left handed archers. Bow B is shown having flexible arms terminating in pulleys P, but it will be appreciated that alternate types of bows can be used in connection with the rest R.

Figure 3:
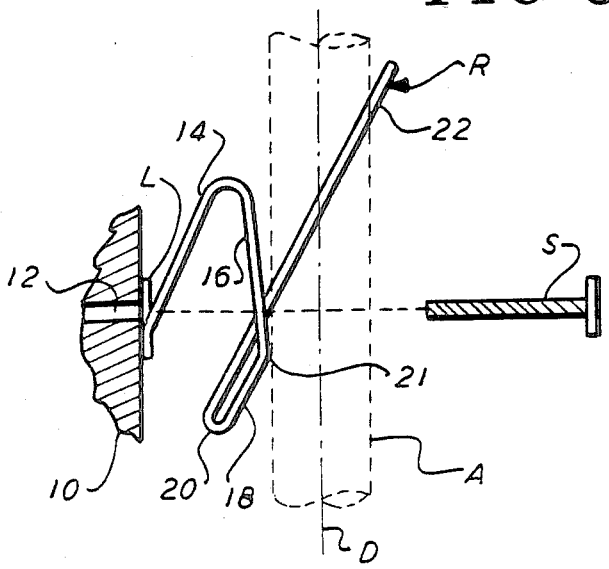
FIG. 3 is a top view of the bow and rest of FIG. 2.

Referring to FIGS. 2 and 3, previously mentioned sight window 10 is shown having a mounting hole 12 which runs transversely through the entire thickness of sight window 10. Mounting hole 12 is of a diameter sufficient to hold a mounting screw for a vernier-type adjustment mounting. These known mountings have a knob which may be turned to cause the opposite end of the mount to project a varying amount. Such known adjustable mounts allow fine tuning of an arrow rest.

Arrow A is shown in FIG. 3 in phantom laying in rest R, with a flight direction D coaxial with the axis of the shaft of arrow A.

Rest R is shown formed of serpentine steel wire. The gauge of the wire can be altered, however, depending upon the length of the respective wire segments, and the desired firmness of the arrow rest. For example, the wire may be music wire 0.026 inch in diameter. Rest R has a mounting means in the form of loop L. While a wire loop is shown, it will be appreciated that plates, blocks, and other shapes may be used for mounting. Preferably, the mounting means will have a mounting aperture to allow screw attachment. Mounting hole 12 is normally threaded to accept a 5/16×24 machine screw.

Loop L runs into a flexible support segment 14. Support segment 14 lies substantially in a horizontal plane and extends forwardly and outwardly from loop L at an angle of about 10° with respect to the flight direction of the arrow A. It will be understood that the loop L and support segment 14 may be shaped differently and may involve flexible straps, or other devices having sufficient flexibility to allow the shifting of the arrow axis described hereinafter. It will be further understood that the angle of support segment 14, can be varied depending upon its length and the desired spacing of the arrow A from sight window 10.

The support segment 14 is joined to a lateral segment comprising a pair of lateral guides 16 and 18. Guide 16 acts as a side cushion and is positioned substantially in a horizontal plane, forming an acute angle of about 2° with respect to flight direction D. It will be understood that differing angles may be employed, depending upon the amount of cushioning desired. It is preferable, however, that this acute angle be sufficiently large so that side cushion 16 touches the arrow only at the apex 21 formed by the obtuse angle between guide 16 and guide 18. The guide segment 18 is at a sharper angle with respect to flight direction D and preferably intersects it at about 30°, although other angular intersections are contemplated. A connecting segment 20 stretches generally downwardly and slightly inwardly from guide 18. Segment 20 can follow various paths, including curved or more angular paths. The connecting segment 20 travels vertically approximately the radius of arrow A.

Connecting segment 20 then connects through a 90 degree turn into the horizontal portion, identified herein as lower segment 22. Lower segment 22 extends forwardly in a horizontal plane at an angle of about 30° with respect to the flight direction D. Segment 22 is sufficiently long to reach past arrow A and provide a wide underlying support. Rest R may be secured to the sight window 10 by screw S or similar attachment means.

It will be noted rest R engages arrow A at two points. The lower segment 22 supports the underside of arrow A. The apex 21 supports the arrow laterally at a position spaced 90° from the support point provided by lower segment 22. It will be also noted that the support points are spaced axially about ½ inch.

To facilitate an understanding of the principles associated with the foregoing rest, its operation will be briefly described in connection with the figures.

Initially the rest is mounted by screw S either directly to the sight window 10 or to a vernier adjustment device as described previously. Thereafter, an arrow may be placed as illustrated in FIGS. 2 and 3, atop segment 22 and alongside the side cushion 16, touching apex 21. The bow may be drawn and aimed at an appropriate target. When the bowstring is released, centerline of arrow A may translate inwardly and/or downwardly. If arrow A moves downwardly, there is sufficient flexibility in segment 22 as well as its supporting segments to accomodate the axial shifting of arrow A. Accordingly, the centerline of arrow A can shift without introducing yaw that would destablize arrow A and degrade its accuracy.

Alternatively, the bowstring may translate the centerline of arrow A such that its axis moves inwardly. Consequently, inward pressure will be applied against apex 21 thereby deflecting segments 14 and 16. This deflection is rather gentle since the segments 14 and 16 follow a lengthy serpentine path over which substantial flexing can occur.

When the feathers of arrow A reach rest R, they impact mainly on the lower segment 22. Because of the routing of the rest R, the lower segment 22 has sufficient flexibility to deflect out of the way of the feather. Therefore the rest R does not introduce yaw or pitch in the arrow.

It is to be appreciated that various modifications may be implemented to the above described preferred embodiment. For example, while the rest may be formed of circular wire, wire of different cross-sections may be used instead. Furthermore, instead of wire, a strap of stamping may be employed to provide equivalent flexibilitiy. It is also to be understood that the lengths of the various segments can be altered to change the flexibility and size of the rest. Also, while certain elements are shown running generally in a vertical or horizontal plane, it will be understood that these planes can be tilted somewhat and yet accomplish the same results. Furthermore, while contact points spaced 90° apart are illustrated, different angular spacings can be employed. Also the various angles formed between rest segments and flight direction can be changed also depending upon the desired flexibility and rest size. While the underside support point is shown positioned axially forward of the lateral support point, this particular spacing can be changed as well and still accomplish similar results. Also, the attachment of the rest can be by a screw, bolt, rivet or similar attaching devices, without departing from the scope of the present invention.

Obviously, many modifications and variations of the present invention are possible in light of the above teachings. It is, therefore, to be understood that within the scope of the appended claims, the invention may be practiced otherwise than as specifically described.

What is claimed is:

1. A rest adapted to be mounted on a bow and adapted to guide an arrow into its flight direction, comprising:

a flexible, elongated element adapted to doubly contact an arrow, said flexible element comprising a serpentine wire, and having:

(a) a lower segment adapted to extend laterally from a bow and positioned, sized and adapted to support the underside of an arrow, said lower segment being skewed and extending at an acute angle with respect to flight direction;

(b) a lateral segment connected to said lower segment, said lateral segment being spaced from and adapted to extend alongside a bow, said lateral segment having a jog adapted to receive an arrow to make single-point contact at said jog, said lateral segment comprising a serial pair of lateral guides oriented with respect to each other at an obtuse angle to form an apex adapted to bear laterally against an arrow; and (c) a connecting segment connecting between said lower and lateral segments, said lateral segment being positioned above said lower segments; and mounting means adapted to attach said flexible element to a bow, the portion of said lateral segment between said jog and said mounting means being acutely bifilar and free to flex, said mounting means comprising:

a loop oriented in a plane parallel to flight direction; and a flexible support segment connected between said loop and said lateral segment to space it away from said loop and adjacent to flight direction.

2. A rest according to claim 1 wherein forward and backward directions have a component aligned with or opposed to flight direction, respectively, and wherein said support segment extends forwardly from said loop at an acute angle to flight direction, said lateral segment extending backwardly from said support segment at an obtuse angle to flight direction.

3. A rest according to claim 2 wherein said connecting segment extends downwardly from said lateral segment and transversely to said flight direction.

4. A rest according to claim 3 wherein said lower segment extends forwardly from said connecting segment.

5. A rest according to claim 4 wherein said lateral segment and said support segment are joined at an acute angle.

6. A rest according to claim 5 wherein said flexible element and said mounting means are formed of a continuous steel wire.

7. A rest according to claim 1 shaped to touch said arrow at only two points, said rest being non-helical throughout.

8. A rest adapted to be mounted on a bow and adapted to guide an arrow into its flight direction, said rest being non-helical throughout, said rest being shaped and adapted to touch an arrow at only two points spaced 90° with respect to an arrow, comprising:

a flexible, elongated element adapted to doubly contact an arrow, and having:

(a) a lower segment adapted to extend laterally from a bow and positioned, sized and adapted to support the underside of an arrow; and (b) a lateral segment connected to said lower segment, said lateral segment being spaced from and adapted to extend alongside a bow, said lateral segment having jog adapted to receive an arrow to make single-point contact at said jog; and mounting means adapted to attach said flexible element to a bow, the portion of said lateral segment between said jog and said mounting means being acutely bifilar and free to flex.

9. A rest according to claim 8 wherein said rest has flexibility to a degree to allow said lower segment to be pushed aside by the passage of arrow feathers.

10. A rest according to claim 9 wherein said rest has flexibility to a degree to allow said arrow to translate transversely to its axis in two orthogonal directions while doubly touching said rest.

* * * * *